US005898948A

United States Patent [19]

Kelly et al.

[11] Patent Number: 5,898,948

[45] Date of Patent: May 4, 1999

[54] SUPPORT/SPORT SOCK

[75] Inventors: Graham M. Kelly, 917 McDiarmid La., Grand Ledge, Mich. 48837; Ray Fredericksen, Haslett, Mich.

[73] Assignee: Graham M. Kelly, Grand Ledge, Mich.

[21] Appl. No.: 08/741,954

[22] Filed: Oct. 31, 1996

[51] Int. Cl.[6] ..... A41B 11/00

[52] U.S. Cl. ..... 2/240; 2/239

[58] Field of Search ..... 2/239, 240, 409, 2/242; 36/113, 114; 66/178 A–178 R, 169 R, 171, 182–188; 602/62, 23

[56] References Cited

U.S. PATENT DOCUMENTS

| | | | |
|---|---|---|---|
| 963,878 | 7/1910 | Diver | 2/239 |
| 2,574,873 | 11/1951 | Jobst . | |
| 2,816,361 | 12/1957 | Jobst . | |
| 4,156,294 | 5/1979 | Horn | 2/409 |
| 4,172,456 | 10/1979 | Zens . | |
| 4,180,065 | 12/1979 | Bowen | 2/239 |
| 4,194,249 | 3/1980 | Thorneburg | 2/239 |
| 4,277,959 | 7/1981 | Thorneburg | 2/239 |
| 4,373,215 | 2/1983 | Guigley | 2/239 |
| 4,397,161 | 8/1983 | Chesebro, Jr. et al. | 2/239 |
| 4,502,301 | 3/1985 | Swallow et al. . | |
| 4,513,740 | 4/1985 | Westlake . | |
| 4,520,635 | 6/1985 | Shields et al. | 2/239 |
| 4,862,523 | 9/1989 | Lipov | 2/409 |
| 5,086,518 | 2/1992 | Staley | 2/239 |
| 5,263,923 | 11/1993 | Fujimoto . | |
| 5,367,708 | 11/1994 | Fujimoto | 2/239 |

*Primary Examiner*—Gloria M. Hale

*Attorney, Agent, or Firm*—Gifford, Krass, Groh, Sprinkle, Patmore, Anderson & Citkowski, P.C.

[57] ABSTRACT

A support/sport sock for enhancing athletic performance. The sock includes a sock body of an elastomeric material which exhibits a pressure gradient against the calf of the leg which varies from a maximum proximate the foot portion of the sock to a minimum at the top end. The sock may include a padded heel portion and ball portion and an absorbent lining. A plurality of biomechanical support panels are incorporated into the sock body at locations thereon corresponding to the major muscle-tendon groups of the lower leg. These biomechanical supports serve to stabilize and support these muscle-tendon groups during athletic activity. The sock may be combined with an athletic shoe or other footwear.

14 Claims, 3 Drawing Sheets

SUPPORT/SPORT SOCK

FIELD OF THE INVENTION

This invention concerns the field of athletic apparel and, more particularly, sport sock designed to enhance the wearer's athletic performance.

BACKGROUND OF THE INVENTION

Elastic compression stockings have long been used for the treatment of chronic venous insufficiency (CVI). Generally, such "anti-embolism" stockings extend over the wearer's leg and foot and are adapted to exhibit a controlled, gradient compressive force on the leg. Typically, the compressive force is greatest at the ankle area and diminished over the length of the stocking to a minimum at the top. Examples of such compression hosiery are disclosed in, for example, U.S. Pat. Nos.: 4,172,456; 4,502,301; 4,513,740; 2,574,873 and 2,816,361.

CVI is defined as any abnormality of the peripheral venous system that reduces or restricts venous return, thereby causing blood pooling and increased venous pressure. Patients exhibiting such blood pooling and increased venous pressure are at increased risk for developing blood clots in their legs, with the attendant risk of the clots breaking loose and traveling through the venous circulation back to the heart and into the lungs, thus leading to a potentially fatal pulmonary embolism. CVI includes a spectrum of circulatory problems, including vein competency, patency and wall properties, as well as extravascular factors. These extravascular factors include the muscle pumps of the foot, calf and thigh which are in turn dependent on proper neuromuscular function and mobility of the joints (particularly the ankle) and connective tissue support by fascia.

The spectrum of symptoms attributed to those afflicted with CVI includes lower leg extremity pain, itching, burning, fatigue, cramps, swelling, and in advanced stages, ulceration of the lower leg. Gradient compression of the leg is highly effective in reducing lower extremity venous pressure and venous pooling. This enables the calf muscle pump to increase venous return. Thus, CVI patients undergoing compression hose therapy are usually relieved of nearly all symptoms, including ulceration.

While gradient compression stockings are in widespread use for the treatment of CVI, they have not heretofore generally been used by those who are free of this disease. Because they are restricted to medical applications, the compression hosiery are usually physician prescribed or are available over the counter upon the recommendations of a physician.

Aerobic type exercise is increasingly becoming a part of the normal fitness regime. The benefits of such exercise need not be discussed in detail here, but include reduced incidence of coronary disease, greater stamina and strength, increased energy levels, increased longevity, etc. Thus, a large number of healthy adults engage in such aerobic exercise on a regular basis.

While undoubtedly beneficial, aerobic exercise and other athletic activities involving the strenuous use of the lower extremities carry certain risks. In particular, the lower leg, ankle, and foot include a number of intricate intrinsic muscle and joint complexes. Instability of the foot and ankle joint complexes resulting from excessive pronation and supination, with added impact trauma to the lower leg, has been associated with a number of overuse injuries. These injuries include Achilles tendinitis, peroneal tendinitis, and plantar fasciitis. The motion of pronation is characterized by inward rotation of the lower leg upon the foot causing the arches to flatten out. Supination involves an outward rotation of the lower leg resulting in high arches in the foot.

Conventional methods of stabilizing the foot and reducing trauma to the lower leg include arch supports, specially designed athletic shoes such as high top basketball shoes, and various athletic training taping procedures. U.S. Pat. No. 5,263,923, for example, discloses a wearing article including highly stretchable portions which extend along the muscle groups of a body portion in order to simulate a "taping" function. These prior art methods have all produced somewhat limited benefits.

Thus, both "weekend" and serious athletes could benefit from increased protection of these intricate muscle and joint complexes. Furthermore, increased blood flow through the lower extremities could well give these athletes a "boost" in performance, as well as reducing fatigue and pain caused by build up of lactic acid within the muscles, as well as reducing the likelihood of developing CVI.

Thus, what is needed is a device which both enhances the performance of casual and serious athletes in an easy to use and nonintrusive manner, and which also provides the added benefit of protecting the user from injury and disease.

SUMMARY OF THE INVENTION

The invention described herein has been designed to overcome the deficiencies in the prior art noted above. The invention is a support/sport sock designed to cover the leg of a wearer and enhance his athletic performance. The support/sport sock includes a sock body having a foot portion configured to enclose the wearer's foot. A cushioning member (heel pad) is disposed in a heel area of the sock portion to cushion and protect the wearer's heel when the wearer is engaged in activity.

The sock body further includes a calf portion which extends up the leg of the wearer for a distance and terminates in a proximal end. In one embodiment of the support/sport sock of the present invention, the calf portion of the sock body extends up to the wearer's knee. In a second embodiment, the calf portion extends only partially up the wearer's calf to form a "crew" length sock.

The sock body is comprised of an elastomeric material (such as a spandex or spandex blend knit) which exerts a compressive force against the wearer's leg. The compressive force exhibits a gradient which varies from a maximum at the foot or ankle of the sock body to a minimum at the proximal end. Such a compressive force gradient can be formed in any manner known in the prior art, such as varying the tension of the elastomeric yarn when the sock is knitted, using panels of compressive forces, using yarns of different elasticity, etc. However the gradient force is achieved, it will cause the sock of the present invention to enhance the natural pumping action of the wearer's calf muscles and increase venous return to the heart. This, in turn, causes increased blood flow into the legs of the user, which increases the amount of available oxygen to the muscle cells of the legs, and enhances athletic performance.

In a further embodiment of the support/sport sock of the present invention, the sock further includes at least one biomechanical panel which is formed of a nonelastomeric material, such as a fabric panel, or, in some cases, a composite or laminated structure which may include some visco-elastic layers. The biomechanical panel is configured to extend along the calf portion of the sock body in a pattern corresponding to a major muscle group of the wearer's calf. A major muscle group is defined as including the musculo-tendon structures which insert into the key bony prominences of the wearer's leg. The biomechanical panel serves to support and protect the major muscle group when the wearer is engaged in physical activity.

The major muscle groups of the lower leg include: the posterior muscle groups which are located in the back of the leg, extending behind the knee; the anterior muscle groups which extend along the tibia (shin bone) of the leg; and the lateral muscle compartments which extend along the outside of the leg. In addition, the ankle region of the foot and leg include the vulnerable crural ligaments of the ankle joint which are particularly prone to injury during running and other athletic activities.

Thus, in a yet further embodiment of the support/sock of the present invention, a plurality of biomechanical support panels are provided. A gastroc support panel is disposed on a posterior surface of the calf portion of the sock body and includes a pair of opposed gastroc pads disposed on either side of a posterior centerline of the calf portion of the sock body. The gastroc support panel serves to lend stability to the posterior muscle groups of the wearer's calf as previously described. An anterior biomechanical support panel extends longitudinally along an anterior surface of the sock body shin portion along the anterior centerline thereof. Optionally, it may extend into the foot portion of the sock body and help support the arch of the wearer's foot. The anterior support panel serves to support the anterior muscle groups along the tibia of the wearer's leg. A peroneal support panel is disposed to extend longitudinally along the lateral side of the sock body. The peroneal support panel extends into the foot portion of the sock body and terminates at the heel bone. The peroneal panel serves to stabilize the lateral muscle compartments of the wearer's leg.

In yet another embodiment, the sock includes an ankle biomechanical support panel. The ankle panel extends along an anterior surface of the calf portion where it joins the foot portion at a location thereon corresponding to the ankle of the wearer. The ankle panel crosses around the posterior surface of the sock body and continues to wrap around the foot portion proximate said arch portion thereof. The ankle panel serves to lend stability to the crural ligaments of the wearer's ankle, and further supports the arch of the wearer's foot. The ankle biomechanical support panel may be combined with one or more of the gastroc, anterior, and peroneal panels previously described, or may be used by itself.

Preferably, the support/sport sock of the present invention further includes a layer of absorbent material (such as polypropylene, cotton, cotton blends, etc.) disposed on the inside of the sock body. This layer of absorbent material serves as an absorbent liner and serves to absorb perspiration generated by the wearer while engaged in activity, thus lending to the comfort of the device.

In another embodiment, the sock may further comprise an athletic shoe or other type of footwear.

BRIEF DESCRIPTION OF THE DRAWINGS

The following detailed description is best understood by reference to the following drawings in which.

DETAILED DESCRIPTION OF THE PREFERRED EMBODIMENTS

Figure 1:
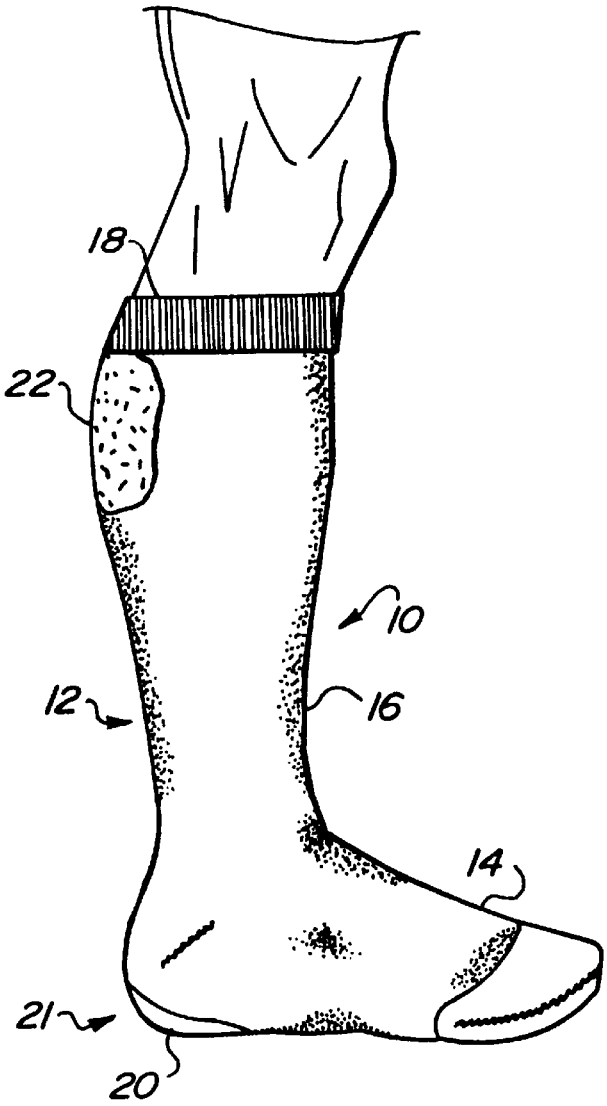
FIG. 1 is a right side (lateral) view of a first embodiment of a support/sport sock constructed in accordance with the principles of the present invention.

Throughout the following detailed description, like numerals are used to reference the same elements of the present invention shown in multiple figures thereof. Referring now to the drawings, and in particular to FIG. 1, there is shown a first embodiment of a bio-physio support/sport sock 10 according to the present invention. The sock 10 includes a sock body 12 having a foot portion 14 and a calf portion 16. The calf portion extends up the wearer's leg to the knee and terminates in a remote end 18.

The sock body 12 is comprised of an elastomeric material (such as a spandex or spandex blend knit, or similar material) which exerts a compressive force against the wearer's leg. The compressive force is graded throughout the calf portion 16 so that it varies from a minimum at said foot portion 14 to a maximum at remote end 18.

The support/sport sock 10 shown in FIG. 1 further includes a heel pad 20 disposed in the heel area 21 of foot portion 14. Typically, heel pad 20 is comprised of a visco-elastic material, although other suitable materials may be used. The purpose of heel pad 20 is to enhance cushioning and improve shock absorption when the wearer is engaged in physical activity. Although not depicted, a similar pad may be provided under the ball of the foot.

As will be discussed in the experimental data below, the embodiment of the present invention shown in FIG. 1 can enhance athletic performance. Specifically, by reducing venous pooling and increasing venous return, exercise capacity can increase, and the performance of even those individuals not affected by CVI can be enhanced. Preferably, the sock includes a layer 22 of absorbent material (such as polypropylene, cotton terry, etc.) which lines the inside of the sock body 12 in order to absorb perspiration and improve the comfort of the support/sport sock 10. The combination of the absorbent layer 22, the heel pad 20 and the pressure gradient results in a unique sports sock particularly adapted to athletic use.

Figure 2:
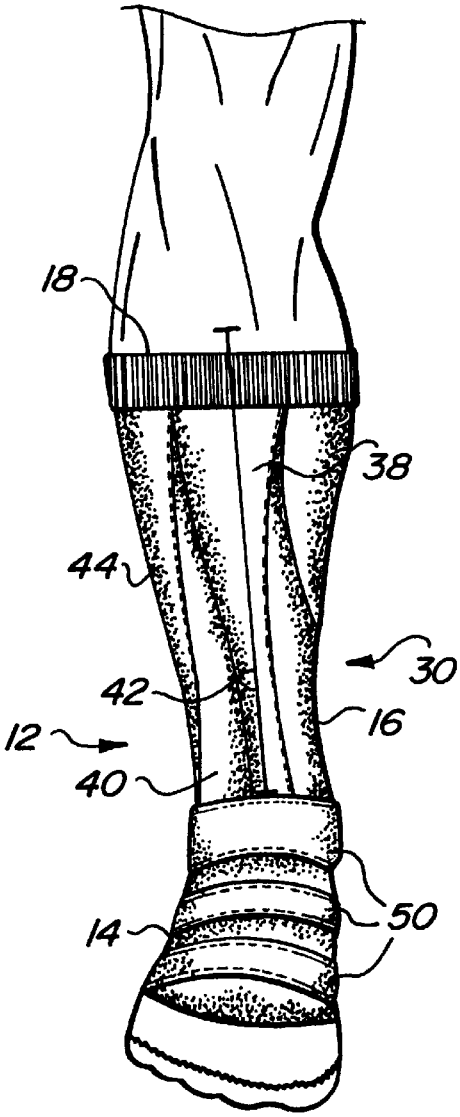
FIG. 2 is a front view of a second embodiment of the sock of the present invention.
Figure 3:
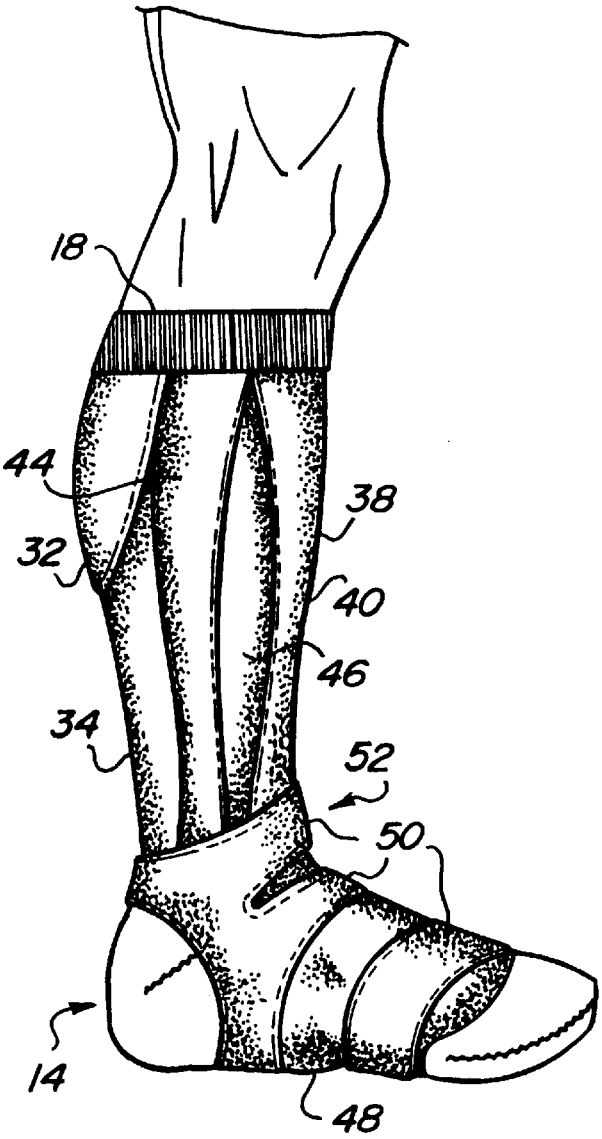
FIG. 3 is a right side (lateral) view of the sock of FIG. 2.
Figure 4:
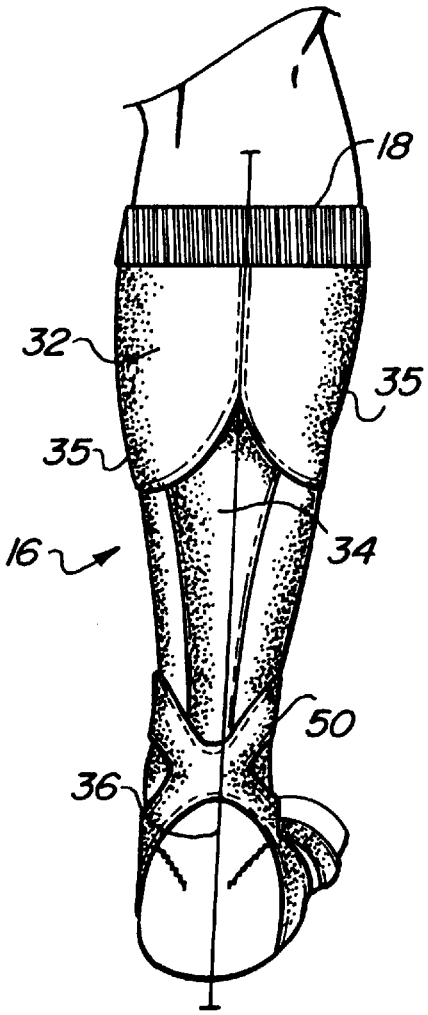
FIG. 4 is a rear view of the sock of FIG. 2.

In an alternative embodiment 30 of the sock of the present invention shown in FIGS. 2–4, a plurality of biomechanical support panels are integrated into the sock body 12. The biomechanical support panels work synergistically with the compression modality described above and provide stability to the musculo-tendon anatomy of the lower leg, and the intricate intrinsic muscles and joint complexes of the foot and ankle.

Specifically, the sock 30 includes a gastroc support panel 32 (best seen in FIG. 4). Gastroc support panel 32 is comprised of a pair of gastroc pads 35 which are disposed on the posterior surface 34 of the calf portion 16 of sock body 12. The pair of gastroc pads 35 are disposed on each side of an approximate posterior centerline 36 of sock body 12. The gastroc support panel 32 is disposed proximate the proximal end 18 of the sock body 12 and extends for a distance down the posterior surface 34 of calf portion 16.

The gastroc support panel 32 provides support and stability for the gastrocnemius and soleus muscles (calf muscles) which originate behind the upper part of the leg and knee and insert via the Achilles tendon into the calcaneus (heel bone).

Disposed longitudinally along the anterior surface 40 of calf portion 16 of sock body 12 is an anterior support panel 38 (best seen in FIG. 2). Anterior support panel 38 extends from proximal end 18 past the ankle portion 52 of sock body 12. It extends into the foot portion 14 and helps support the arch 48 of the wearer's foot. Anterior support panel 38 serves to support and protect the tibialis anterior, a muscle which originates along the tibia bone (shin bone), and inserts into the first cuneiform and base of the first metatarsal bone of the foot.

A peroneal support panel 44 extends longitudinally along the lateral surface 46 of calf portion 16 and extends from proximal end 18 to terminate in sock body 12 underneath the heel bone of the foot. The peroneal support panel 44 serves to stabilize and support the lateral muscle compartment. This includes the peroneal muscles, which originate on the outside of the calf and extend along the fibula bone of the lower leg to insert at the base of the fifth metatarsal head (brevis), and the base of the first metatarsal bone and first cuneiform bone (longus).

The muscle-tendon arrangement of the lower leg functions as a system of pulleys to support and manipulate the complex joint systems of the foot in order to perform simple motions, such as walking, and to accomplish more dynamic movement patterns such as running or jumping. A critical functional design feature of the biomechanical support panels is that they originate in the calf portion of the sock and extend along the muscular anatomy of the lower leg, with insertion underneath the arch portion of the sock.

Support/sport sock 30 further includes an ankle biomechanical support panel 50. Ankle panel 50 is configured as a figure eight pattern which wraps around the ankle joint 52 and the arch portion 48 to lend stability to the crural ligaments of the ankle and to support the arches of the foot. Like the other biomechanical support panels, ankle panel 50 may be comprised of fabric reinforcements, visco-elastic, or composite inlays. Unlike the elastomeric material of which the sock body is comprised, the biomechanical panels are relatively nonelastic.

Although both depicted embodiments of the support/sport sock show a knee high sock, in actual fact the height of the sock of the present invention may range from the tibial fossa, at the knee joint, to crew length at the midpoint of the calf muscle. The knee length design delivers maximum function to enhance venous blood return and stabilize the entire lower leg anatomy. The crew height sock provides compression and stability but to a lesser degree and is particularly suitable for activities where coolness and comfort dictate over function.

Figure 5:
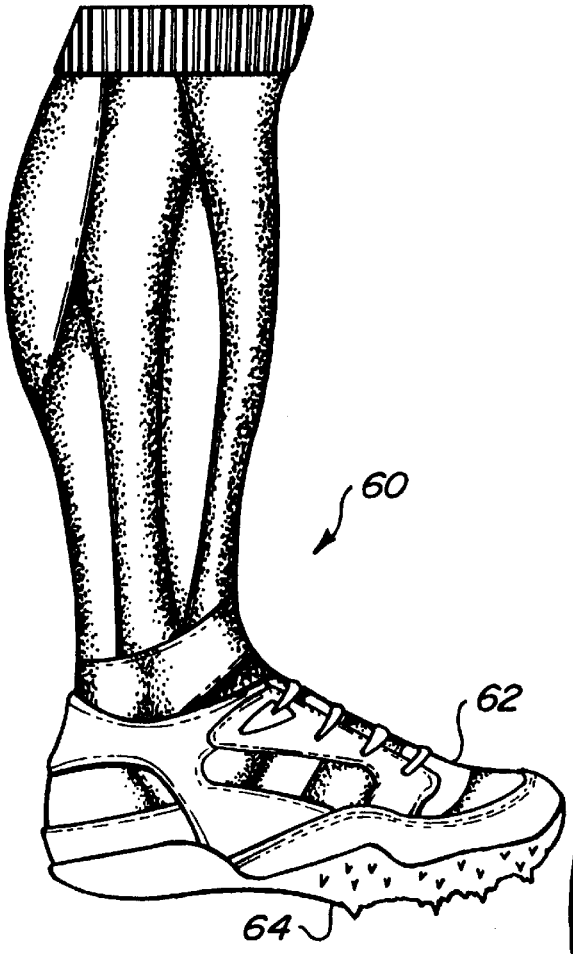
FIGS. 5 and 6 illustrate the embodiments of the sock of the present invention incorporating athletic shoes.
Figure 6:
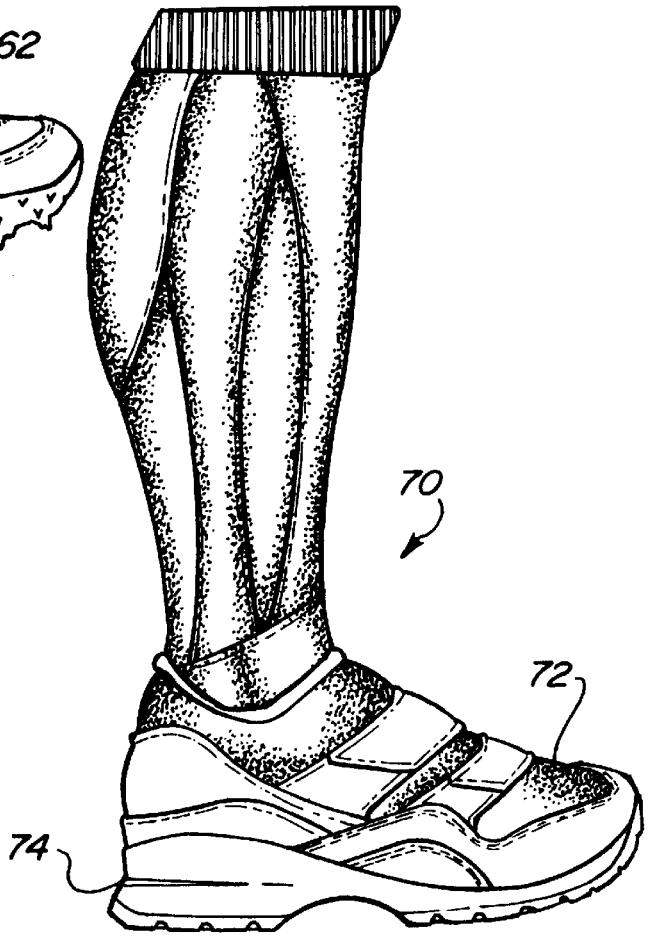

In addition to the depicted heel pad, the sock of the present invention may incorporate visco-elastic materials under the sole of the sock in the area of the metatarsal heads to further enhance cushioning and shock absorption. Additionally, the sock may be modified to incorporate a sport shoe or dance slipper design. In the embodiment 60 depicted in FIG. 5, the sock is integrated into a conventional racing shoe or track shoe design, including an upper 62 and shoe sole 64 system. FIG. 6 depicts another variation 70 on this concept. It incorporates a training shoe upper 72 and sole 74 (compression molded EVA midsole and rubber lug outside) into the sock.

The incidence of venous disease is estimated to be 50% of the population. This population is also shifting largely to an age group over 50, when the effects of venous disease are most noticeable. Exercise has become more than a passing fad for this age group, and it is responsible for purchasing a large and growing percentage of sporting equipment. Any device that can potentially enhance performance, improve venous function, and reduce pains associated with aging will be enthusiastically embraced. For the younger athlete or healthy older individual, the support/sport sock of the present invention is more physiologic and may offer additional benefits as well. It should be noted that current "runnings tights" are not designed with a pressure gradient, and may actually reduce venous return. In sharp contrast to the present invention, such tights may result in diminished performance.

Experimental

Aerobic exercise performance is dependent on two main factors: a) aerobic capacity ($VO_{2max}$) and b) the % of $VQ_{max}$ which can be used effectively during intense competition.

Maximal Exercise

Stated quite simply, $VO_{2max}$ is equal to the product of maximal:

heart rate×stroke volume×a-v $O_2$ difference

Mathematically speaking, if one could increase any of these variables without negatively affecting the others, his/her $VO_{2max}$ would increase.

Heart rate is obvious. In this case, we are interested in maximal heart rate. This is largely independent of training, may be negatively influenced by therapeutic drugs (i.e., blood pressure medication) and would not likely be affected by the SOCK.

<u>a-v $O_2$</u> difference is the amount of $O_2$ that can be extracted in the muscles. Literally, it is the amount of $O_2$ in the arterial blood entering the muscle capillaries, minus the amount of $O_2$ in the venous blood leaving the capillaries. It is also known as $O_2$ "extraction". This is a "peripheral" variable that varies from muscle to muscle within an individual, depending on level and type of training. We are basically talking about enzyme capabilities of individual muscle fibers, so the SOCK would not likely affect this variable.

On the other hand, Stroke Volume could very well be affected by the SOCK. During exercise, stroke volume (the amount of blood pumped per heart beat) increases by a) higher levels of circulating catecholamines such as epinephrine and b) increasing venous return to the heart. By increasing venous return, we mean simply that the "muscle pump" of the arms and legs helps return blood to the heart quickly, so it can be pumped out again. All things being equal, the more blood returned to the heart in a given amount of time, the more pumped out. While the muscles do a good job of squeezing the veins to aid this process during exercise, it is possible that the SOCK could aid this effort. We know that the deep veins of the legs, and the skin area are very compliant and can hold a great deal of blood volume. By adding external pressure from the SOCK, this compliance may be reduced, and venous return increased. If this occurs, Stroke Volume could increase and increase $VO_{2max}$.

Tables A and B show, respectively, the results comparing these factors for a subject (23 year old female) tested with (Table A) and without (Table B) the sock of the present invention. We see a 5% increase in $O_{2pulse}$ (which is an indirect index of stroke volume) during the SOCK trial (results included). This resulted in a 22.5% increase in $VO_{2max}$.

TABLE A

| MIN | SPEED | GRADE | WORK | HR | 02 PULS | VE BTPS | RR | TV | SBP | DBP | VO2 | VO2/KG | R |
|---|---|---|---|---|---|---|---|---|---|---|---|---|---|
| EXERCISE | | | | | | | | | | | | | |
| 00:01:00 | 2.7 | | | 99 | 4.8 | 17.2 | 19 | 0.90 | | | 480 | 7.75 | 0.97 |
| 00:02:00 | 3.2 | | | 104 | 8.1 | 21.5 | 18 | 1.19 | | | 844 | 13.61 | 0.78 |
| 00:03:00 | 3.7 | | | 110 | 9.2 | 28.2 | 23 | 1.21 | | | 1010 | 16.29 | 0.84 |
| 00:04:00 | 4.2 | | | 123 | 9.3 | 33.3 | 27 | 1.25 | | | 1136 | 18.32 | 0.88 |
| 00:05:00 | 4.7 | | | 136 | 11.2 | 49.1 | 30 | 1.61 | | | 1520 | 24.51 | 0.98 |
| 00:06:00 | 5.2 | | | 144 | 12.3 | 62.6 | 35 | 1.81 | | | 1774 | 28.62 | 1.06 |
| 00:07:00 | 5.7 | | | 149 | 12.2 | 66.6 | 38 | 1.74 | | | 1815 | 29.27 | 1.03 |
| 00:08:00 | 6.0 | 1.6 | 26 | 155 | 13.2 | 70.4 | 40 | 1.77 | | | 2044 | 32.97 | 0.98 |
| 00:09:00 | 6.0 | 4.7 | 77 | 161 | 14.5 | 81.0 | 46 | 1.78 | | | 2326 | 37.52 | 0.97 |
| 00:10:00 | 6.0 | 7.5 | 122 | 167 | 15.4 | 88.5 | 45 | 1.95 | | | 2560 | 41.30 | 0.98 |
| 00:11:00 | 6.0 | 10.6 | 173 | 174 | 16.7 | 109.7 | 54 | 2.03 | | | 2903 | 46.82 | 1.07 |
| 00:12:00 | 6.0 | 13.6 | 222 | 177 | 17.5 | 122.5 | 64 | 1.91 | | | 3104 | 50.06 | 1.12 |
| ACTIVE RECOVERY | | | | | | | | | | | | | |
| 00:12:20 | 2.5 | 8.0 | 54 | 176 | 12.5 | 85.6 | 53 | 1.62 | | | 2207 | 35.60 | 1.18 |

TABLE B

| MIN | SPEED | GRADE | WORK | HR | 02 PULS | VE BTPS | RR | TV | SBP | DBP | VO2 | VO2/KG | R |
|---|---|---|---|---|---|---|---|---|---|---|---|---|---|
| BASELINE | | | | | | | | | | | | | |
| 00:01:00 | | | | 96 | 2.9 | 13.9 | 16 | 0.87 | | | 273 | 4.43 | 1.24 |
| EXERCISE | | | | | | | | | | | | | |
| 00:02:00 | 2.7 | | | 120 | 3.8 | 21.6 | 21 | 1.03 | | | 453 | 7.34 | 1.17 |
| 00:03:00 | 3.2 | | | 122 | 5.3 | 22.3 | 20 | 1.13 | | | 648 | 10.50 | 0.92 |
| 00:04:00 | 3.7 | | | 128 | 7.0 | 24.7 | 20 | 1.23 | | | 895 | 14.51 | 0.80 |
| 00:05:00 | 4.2 | | | 134 | 8.4 | 31.4 | 23 | 1.38 | | | 1123 | 18.20 | 0.86 |
| 00:06:00 | 4.7 | | | 139 | 10.7 | 40.9 | 23 | 1.74 | | | 1489 | 24.14 | 0.89 |
| 00:07:00 | 5.2 | | | 150 | 11.5 | 53.6 | 31 | 1.74 | | | 1721 | 27.89 | 0.96 |
| 00:08:00 | 5.6 | | | 156 | 10.9 | 58.3 | 33 | 1.75 | | | 1701 | 27.57 | 1.00 |
| 00:09:00 | 6.0 | 1.6 | 26 | 161 | 11.9 | 64.6 | 35 | 1.84 | | | 1912 | 30.99 | 0.97 |
| 00:10:00 | 6.1 | 4.6 | 75 | 164 | 13.1 | 70.5 | 40 | 1.75 | | | 2158 | 34.98 | 0.95 |
| 00:11:00 | 6.0 | 7.6 | 123 | 170 | 14.4 | 81.4 | 43 | 1.88 | | | 2453 | 39.75 | 0.96 |
| 00:12:00 | 6.0 | 10.6 | 173 | 175 | 15.9 | 95.0 | 49 | 1.94 | | | 2792 | 45.25 | 1.01 |
| 00:13:00 | 6.0 | 13.6 | 220 | 181 | 16.7 | 114.7 | 61 | 1.88 | | | 3024 | 49.02 | 1.10 |
| ACTIVE RECOVERY | | | | | | | | | | | | | |
| 00:13:40 | 2.5 | 7.8 | 53 | 174 | 6.1 | 41.1 | 26 | 1.60 | | | 1057 | 17.13 | 1.14 |

In short, the support/sport sock of the present invention offers improved cardiovascular return, thus both enhancing athletic performance, and helping to prevent the development of CVI in susceptible individuals. Moreover, the biomechanical support panels, in addition to protecting and supporting the major muscle-tendon groups of the calf and foot, also enhance the pumping effect of the sock, thus combining synergistically with the pressure gradient. The combined effect of gradient compression and support panels can also reduce the pain of existing injuries of the foot and ankle while, at the same time, provide support to these structures and promote accelerated healing. Additionally, the sock of the present invention has the great advantage that it may be purchased off the shelf without a medical prescription. It is easy to put on and comfortable to wear.

While the support/sport sock of the present invention has been described with reference to certain embodiments and exemplifications thereof, the invention is not limited to the exact depicted designs. One of skill in the art, having had the benefit of the teachings of the present invention, may design certain variations thereof without departing from the scope of the present invention. Thus, it is the claims appended hereto, as well as all reasonable equivalents thereof, rather than the exact depicted embodiments, which define the true scope of the present invention.

We claim:

1. A support/sport sock for covering the leg of a wearer and comprising:

a sock body including a foot portion configured to enclose said wearer's foot and a calf portion extending up the leg of said wearer and terminating in a proximal end, said sock body comprised of an elastomeric material formed to exert a compressive force against said leg, wherein said elastomeric material provides said compressive force as being graded throughout the calf portion such that said gradient varies from a maximum proximate said foot to a minimum at said proximal end; and a cushioning member disposed in a heel area of said sock portion to cushion and protect the heel of said wearer's foot when said wearer is engaged in activity.

2. The sock of claim 1 further comprising a layer of absorbent material disposed on an inside surface of said sock body to absorb perspiration.

3. The sock of claim 1 wherein said elastomeric material is a knitted spandex blend.

4. The sock of claim 1 further comprising a shoe upper and sole attached to said sock body.

5. A support/sport sock for covering the leg of a wearer and comprising:

a sock body including a foot portion configured to enclose said wearer's foot and a calf portion extending up the leg of said wearer and terminating in a proximal end, said sock body comprised of an elastomeric material formed to exert a compressive force against said leg, wherein said elastomeric material provides said compressive force as being graded throughout the calf portion such that said gradient varies from a maximum proximate said foot to a minimum at said proximal end;

a cushioning member disposed in a heel area of said sock portion to cushion and protect the heel of said wearer's foot when said wearer is engaged in activity; and at least one biomechanical panel, said biomechanical panel being formed of a nonelastomeric material, said panel extending along said calf portion of said sock body in a pattern corresponding to a major muscle group of said wearer's calf, said major muscle group defined as including the musculo-tendon structures which insert into key bony prominences of the wearer's leg, said at least one panel serving to support and protect said major muscle group when the wearer is engaged in physical activity.

6. A support/sport sock for covering the leg of a wearer and comprising:

a sock body including a foot portion configured to enclose said wearer's foot and a calf portion extending up the leg of said wearer and terminating in a remote end, said sock body comprised of an elastomeric material exerting a compressive force against said leg, said compressive force exhibiting a gradient varying from a maximum at said foot to a minimum at said remote end;

a plurality of biomechanical panels formed of a nonelastomeric material, said plurality of panels including:

a gastroc support panel disposed proximate said remote end of said sock body and extending downwardly for a distance therefrom, said gastroc support panel being disposed on a posterior surface of said calf portion of said sock body and including a pair of opposed gastroc support pads disposed on each side of a posterior centerline of said calf portion, said gastroc support panel serving to lend stability to the posterior muscle groups of said wearer's calf;

an anterior panel extending longitudinally along an anterior surface of said calf portion of said sock body along an anterior centerline thereof, said anterior support panel serving to support the anterior muscle groups along the tibia of said wearer's leg; and a peroneal support panel disposed to extend longitudinally along the lateral side of said calf portion of said sock body, said peroneal support panel extending into said foot portion of said sock body and terminating underneath an arch portion thereof, said peroneal panel serving to stabilize the lateral muscle compartment of said wearer's leg; and a cushioning member disposed in a heel area of said sock portion to cushion and protect the heel of said wearer's foot when said wearer is engaged in activity.

7. The sock of claim 6 further comprising a layer of absorbent material disposed on an inside surface of said sock body to absorb perspiration.

8. The sock of claim 6 further comprising an ankle biomechanical support panel, said ankle panel extending along said anterior surface of said calf portion at a location thereon corresponding to the ankle of said wearer, crossing around the posterior surface of the sock body, and continuing to wrap around said foot portion proximate said arch portion thereof, said ankle panel serving to lend stability to the crural ligaments of the wearer's ankle and support the arches of the wearer's foot.

9. The sock of claim 6 further comprising a shoe upper and sole attached to said sock body.

10. A support/sport sock for covering the leg of a wearer and comprising:

a sock body including a foot portion configured to enclose said wearer's foot and a calf portion extending up the leg of said wearer and terminating in a proximal end, said sock body comprised of an elastomeric material exerting a compressive force against said leg, said compressive force exhibiting a gradient varying from a maximum at said foot to a minimum at said proximal end;

a cushioning member disposed in a heel area of said sock portion to cushion and protect the heel of said wearer's foot when said wearer is engaged in activity; and at least one biomechanical panel, said biomechanical panel being formed of a nonelastomeric material, said panel extending along said calf portion of said sock body in a pattern corresponding to a major muscle group of said wearer's calf, said major muscle group defined as including the musculo-tendon structures which insert into key bony prominences of the wearer's leg, said at least one panel serving to support and protect said major muscle group when the wearer is engaged in physical activity.

11. The sock of claim 10 further comprising a plurality of said biomechanical panels, said plurality of panels including:

a gastroc support panel disposed proximate said proximal end of said sock body and extending downwardly for a distance therefrom, said gastroc support panel being disposed on a posterior surface of said calf portion of said sock body and including a pair of opposed gastroc support pads disposed on each side of a posterior centerline of said calf portion, said gastroc support panel serving to lend stability to the posterior muscle groups of said wearer's calf;

an anterior panel extending longitudinally along an anterior surface of said shin portion of said sock body along an anterior centerline thereof, said anterior support panel serving to support the anterior muscle groups along the tibia of said wearer's leg and extending underneath the foot to support the medial longitudinal arch; and a peroneal support panel disposed to extend longitudinally along a lateral side of said calf portion of said sock body, said peroneal support panel extending into said foot portion of said sock body and terminating underneath an arch portion thereof, said peroneal panel serving to stabilize the lateral muscle compartment of said wearer's leg.

12. The sock of claim 11 further comprising an ankle biomechanical support panel, said ankle panel extending along said anterior surface of said calf portion at a location thereon corresponding to the ankle of said wearer, crossing around the posterior surface of the sock body, and continuing to wrap around said foot portion proximate said arch portion thereof, said ankle panel serving to lend stability to the crural ligaments of the wearer's ankle and support the arches of the wearer's foot.

13. The sock of claim 10 wherein said nonelastomeric material is a woven fabric.

14. A support/sport sock for covering the leg of a wearer and comprising:

a sock body including a foot portion configured to enclose said wearer's foot and a calf portion extending up the leg of said wearer and terminating in a proximal end, said sock body comprised of an elastomeric material exerting a compressive force against said leg, said compressive force exhibiting a gradient varying from a maximum at said foot to a minimum at said proximal end;

a cushioning member disposed in a heel area of said sock portion to cushion and protect the heel of said wearer's foot when said wearer is engaged in activity; and a shoe upper and sole attached to said sock body.

* * * * *